US007153247B1

(12) United States Patent
Filkoff

(10) Patent No.: US 7,153,247 B1
(45) Date of Patent: Dec. 26, 2006

(54) UNDERWATER EXERCISER APPARATUS

(76) Inventor: Larry A. Filkoff, 877 Palermo Rd., Jacksonville, FL (US) 32216-9339

( * ) Notice: Subject to any disclaimer, the term of this patent is extended or adjusted under 35 U.S.C. 154(b) by 580 days.

(21) Appl. No.: 10/445,675

(22) Filed: May 27, 2003

(51) Int. Cl.
*A63B 21/00* (2006.01)

(52) U.S. Cl. ..... 482/121; 482/126; 482/148

(58) Field of Classification Search ..... 482/140–142, 482/91, 148, 126, 121, 81, 82; 441/133; 601/132; D24/211, 131
See application file for complete search history.

(56) References Cited

U.S. PATENT DOCUMENTS 932,780 A * 8/1909 Hero ..... 601/132
3,757,370 A * 9/1973 Seno et al. ..... 441/133
4,177,985 A * 12/1979 Hlasnicek et al. ..... 482/82
4,605,219 A * 8/1986 Mahana et al. ..... 482/82
4,650,433 A 3/1987 Lee
4,768,774 A 9/1988 Beasley
5,004,228 A * 4/1991 Powers ..... 482/91
5,230,697 A * 7/1993 Castillo et al. ..... 602/16
5,242,352 A 9/1993 Elliott
5,422,978 A * 6/1995 Oh et al. ..... 706/2
5,498,218 A * 3/1996 Proctor et al. ..... 482/10
5,607,331 A 3/1997 Lekhtman
5,702,331 A 12/1997 Perham
D396,297 S * 7/1998 Breznik ..... D24/211
5,984,845 A * 11/1999 Powers ..... 482/148
6,056,613 A 5/2000 Pike
6,524,226 B1 * 2/2003 Kushner ..... 482/126
6,752,746 B1 * 6/2004 Winkler et al. ..... 482/82

* cited by examiner

*Primary Examiner*—Jerome Donnelly
(74) *Attorney, Agent, or Firm*—Ira S. Dorman

(57) ABSTRACT

A pair of calf to shoulder length buoyant hand-grip bars are connected at one end of each hand-grip bar to an end of a flexible line upon which is mounted a tubular buoyant foot support bar spaced from the hand-grip bars.

7 Claims, 2 Drawing Sheets

UNDERWATER EXERCISER APPARATUS

BACKGROUND OF THE INVENTION

1. Field of the Invention

The invention pertains to exercise apparatus, more particularly to a user-manipulated force-resisting apparatus utilizing fluid resistance, that buoyantly supports the user. The apparatus provides support for suspending a bather in water, and water-resistance leg and arm exercise for a jogging bather.

2. Description of the Prior Art

The prior art is replete with patented designs for buoyant jogging exercise apparatus. U.S. Pat. No. 5,242,352, patented Sep. 7, 1993 by T. H. Elliott describes an underwater handle in a pool of water, drawn downward by the upward force of a float expressed through a rope which passes through a pulley mounted on the bottom of the pool. The person, standing or sitting in the pool, exercises by pulling upward on the handle with the person's submerged arm.

U.S. Pat. No. 5,702,331, patented Dec. 30, 1997 by C. M. Perham describes a buoyant foam body having a tapered hole through the body. The hole is sized for receiving the foot or hand in a relaxed extended manner so that it stays on the hand or foot without need for gripping the body by the hand or foot.

U.S. Pat. No. 4,768,774, patented Sep. 6, 1988 by B. L. Beasley describes a buoyant, elongated and columnar shaped flexible bar having laterally extending handles at each end of the bar.

U.S. Pat. No. 6,056,613, patented May 2, 2000 by K. E. Pike describes a no-hands flotation device of an elastic, longitudinally stretchable elongated tubing having closure devices on each end of the tubing to form the tubing into an endless elastic loop that is longitudinally stretchable between expanded and contracted positions, and a plurality of sections of buoyant material positioned on the tubing.

SUMMARY OF THE INVENTION

It is one object of the invention to provide a water-resistance arm and leg exerciser for use by a bather in water.

It is another object of the invention to provide a a water-resistance arm and leg exerciser for use by a bather in water, that buoys up the bather in the water.

It is another object of the invention to provide a pair of buoyant flexible elongated handle bars connected at one end of each bar by a length of flexible line that contains a plurality of foot bars.

It is another object that each of the flexible handle bars be at least as long as a distance from a shoulder to a calf of a bather.

An apparatus for exercise by a person having feet below the surface of a body of water, includes a first buoyant bar having a first length, a first end and a second end, a second buoyant bar having a second length, a third end, and a fourth end unattached from the first end so that the person can move the first end independently of the fourth end against resistance of the water, a flexible tubular line, having a third length, a fifth end and a sixth end, the fifth end of the flexible line inserted into the second end of the first buoyant bar, the sixth end of the flexible line inserted into the third end of the second buoyant bar, and a plurality of buoyant tubular bars mounted in tandem on the flexible tubular line.

An apparatus for exercise by a person having feet below the surface of a body of water includes a first buoyant bar having a first length for extending at least from a calf to a shoulder of the person, a first end and a second end, a second buoyant bar having a second length for extending from at least a calf to a shoulder of the person, a third end, and a fourth end unattached from the first end so that the person can move the first end independently of the fourth end against resistance of the water, a flexible line having a third length for bridging the person's feet at least when the feet are together, a fifth end and a sixth end, the fifth end of the flexible line attached to the second end of the first buoyant bar, the sixth end of the flexible line attached to the third end of the second buoyant bar, and a third buoyant tubular bar mounted on the flexible line between the first buoyant bar and the second buoyant bar.

The fifth end of the flexible line is removably attached to the second end of the first buoyant bar. A fourth buoyant tubular bar is mounted on the flexible line in tandem with the third buoyant tubular bar between the first buoyant bar and the second buoyant bar. The flexible line comprises a hollow tube and the first buoyant bar and second buoyant bar are made of flexible foam material which can be plastic or rubber. The third buoyant bar is preferably made of foam material which can be plastic or rubber. In another preferred construction of the invention, the third buoyant tubular bar comprises a sealed hollow cylindrical wall.

In another preferred construction of the invention, the first and second buoyant bars are each tubular.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
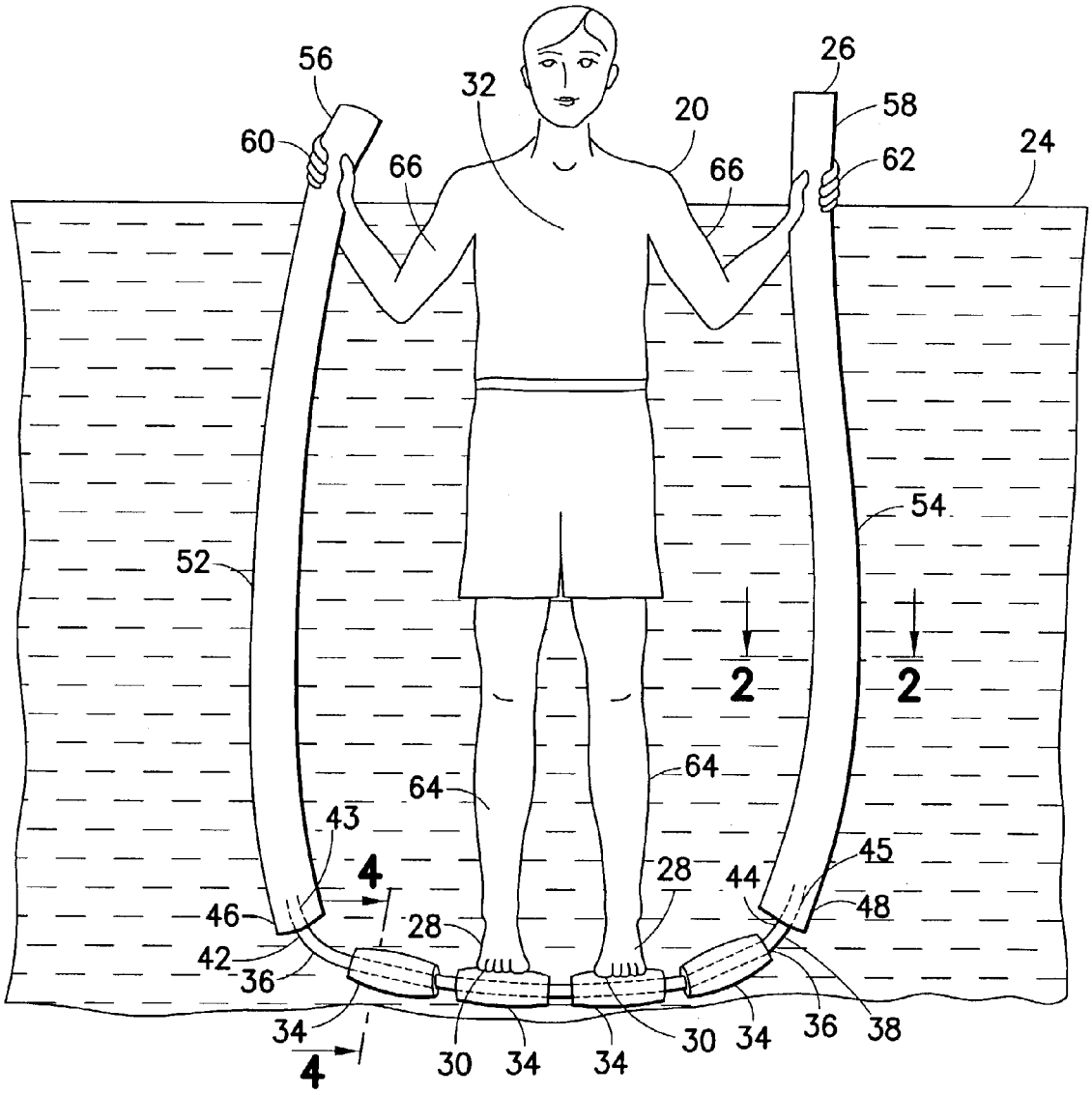
FIG. 1 is a front schematic view of a person using an exerciser of the invention in water.
Figure 2:
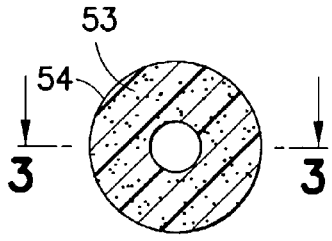
FIG. 2 is a cross section view of an arm bar of FIG. 1, taken along 2—2.
Figure 3:
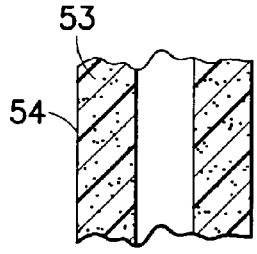
FIG. 3 is a cross section view of the arm bar of FIG. 2 taken along 3—3.
Figure 4:
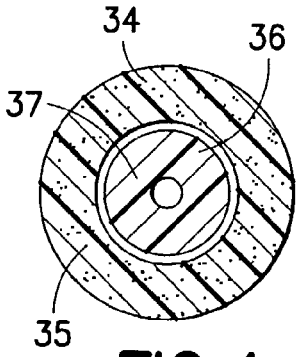
FIG. 4 is a cross section view of a the foot bridge of FIG. 1 taken along 4—4.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

In FIG. 1, person 20 is jogging at chest level in water 24 with exerciser 26 of the invention. His feet 28 are in pressing contact 30 against foot bars 34 which are mounted in tandem on flexible line 36 so that a flexible, buoyant foot support bridge 38 is formed.

Foot support bridge 38 is attached at ends 42, 44 respectively of the bridge to ends 46, 48 of arm bars 52, 54. Preferably attachment of ends 42, 44 to ends 46, 48 is by inserting ends 43, 45 of line 36, into arm bars 52, 54 and gluing.

Ends 56, 58 of arm bars 52, 54 are gripped by the person's hands 60, 62.

Arm bars 52, 54 are preferably flexible enough to bend when pulled forward and back in water by the person's hands. Preferably each one of bars 52, and 54 is stiff enough to not fold under water from its own buoyancy when it is held horizontal by one end of the bar.

Preferably each arm bar is a tube.

Ends 56, 58 are unattached to one another so that they can be moved by the person's hands independently of one another when arm bars 52, 54 are in water to provide resistance in different directions simultaneously to movement in the water.

Foot bars 34 and arm bars 52, 54 are made of buoyant material so that the entire apparatus would float up to the surface of the water if it were not for the feet and hands of the person contacting the apparatus. Consequently the apparatus buoys the person higher in the water than if the person would have been in the water without the apparatus.

Preferably the foot bars and arm bars are made of foam plastic or rubber that is closed cell, or that is sealed on the outer surface so that it cannot become waterlogged.

Preferably each arm 52, 54 is longer than line 36 from bar 52 to bar 54.

Either the foot bar, arm bar or both can be made of hollow plastic shell so long as the shell does not collapse under use.

Preferably the buoyant lift of exerciser 26 is such that it lifts the person as high as the sternum 32.

Referring to FIGS. 1–4, a test exerciser was constructed having the following dimensions. Each arm bar 52, 54 is a 58 inches long, 2.5 inches in diameter foam plastic 53 tube. Each foot bar 34 is larger in the center than at its ends, made of foam plastic 35, 1.5 inches across the largest diameter, and 4 inches long. Line 36 is flexible tubular plastic 37, 0.75 inches outer diameter, 42 inches long from bar 52 to bar 54, and extends further into bars 52 and 54.

This inventor exercised in 3–4 feet of water and found the test exerciser to work moderately well. In water that was deeper than the height of the inventor, the apparatus performed extremely well, while lifting the inventor above the water below his sternum, it provided smooth resistance to movement that imitated a stationary bicycle and a stair stepper. It provides smooth resistance to movement that imitates cross country skiing.

Resistance by the water to movement of the person's legs 64, arms 66, arm bars 52, 54, and foot support bridge 38 enhances the exercise experience. Moving the legs 64 in opposite directions, the arms 66 in opposite directions further enhances the exercise experience.

Figure 5:
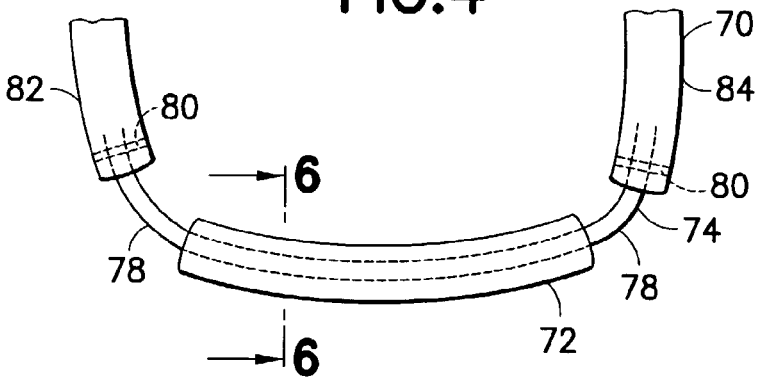
FIG. 5 is a front partial front view of another exerciser according to the invention.
Figure 6:
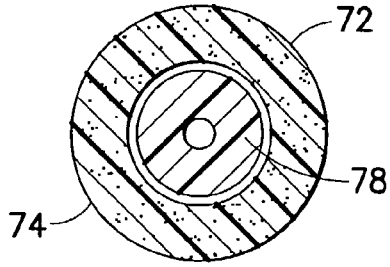
FIG. 6 is a cross section view of the foot support bridge of FIG. 5 taken along 6—6.

In FIGS. 5 and 6, exerciser 70, Styrofoam t.m. flexible buoyant tubular bar 72 of flexible foot support bridge 74 is mounted on flexible plastic tube 78 that is fastened by glue, pins 80 or other fastening means, to buoyant arm bars 82, 84.

Figure 7:
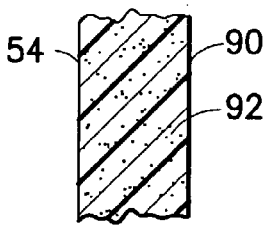
FIG. 7 is a cross section side view of an arm bar according to the invention.

In FIG. 7, arm bar 90 is made of semi-rigid, closed cell foam 92 plastic. The closed-cell foam does not take on water and become water logged.

Figure 8:
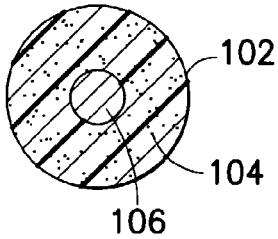
FIG. 8 is a cross section side view of a foot support bridge of another exerciser according to the invention.

In FIG. 8, foot support bridge 102 includes tubular foam material bar 104 mounted on flexible solid plastic rod 106.

Figure 9:
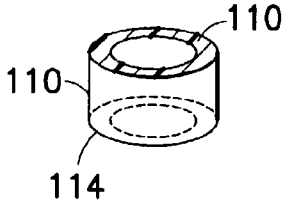
FIG. 9 is a cross section perspective view of another foot support buoyant bar according to the invention.

In FIG. 9, sealed cylindrical wall 110 of tubular bar 114 provides strength and buoyancy for supporting a foot of the person exercising.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

I claim:

1. An apparatus for exercise, by a person having feet below the surface of a body of water, comprising:

a first buoyant bar having a first length, a first end and a second end, a second buoyant bar having a second length, a third end, and a fourth end not attached to said first end so that the person can move the first end independently of the fourth end against resistance of the water, a flexible line having a third length, a fifth end and a sixth end, the fifth end of said flexible line attached to the second end of said first buoyant bar, the sixth end of said flexible line attached to the third end of said second buoyant bar, and a plurality of buoyant tubular bars mounted on said flexible line, so that the person may take exercise by moving the first and second bars with the person's hands and moving the tubular bars with the persons feet against water resistance, said first buoyant bar being longer than said flexible line taken from the second end of said first buoyant bar to the third end of said second buoyant bar.

2. The apparatus of claim 1 wherein said second buoyant bar is longer than said flexible line taken from the second end of said first buoyant bar to the third end of said second buoyant bar.

3. An apparatus for exercise, by a person having feet below the surface of a body of water, comprising:

a first buoyant tubular bar having a first length, a first end and a second end, a second buoyant bar having a second length, a third end, and a fourth end not attached to said first end so that the person can move the first end independently of the fourth end against resistance of the water, a flexible tubular line having a third length, a fifth end and a sixth end, the fifth end of said flexible line inserted into the second end of said first buoyant bar, the sixth end of said flexible line inserted into the third end of said second buoyant bar, and a plurality of buoyant tubular bars mounted in tandem on said flexible tubular line, so that the person may take exercise by moving the first and second bars with the person's hands and moving the tandem tubular bars with the person's feet against water resistance, said first buoyant tubular bar being longer than said flexible tubular line taken from the second end of said first buoyant tubular bar to the third end of said second buoyant bar.

4. The apparatus of claim 1 wherein the fifth end of said flexible line is removably attached to the second end of said first buoyant bar.

5. The apparatus of claim 1 wherein said flexible line comprises a hollow tube, and said first buoyant bar and said second buoyant bar are made of flexible foam material.

6. An apparatus, for exercise by a person having feet below the surface of a body of water, comprising:

a first buoyant bar having a first length, a first end and a second end, a second buoyant bar having a second length, a third end, and a fourth end not attached to said first end so that the person can move the first end independently of the fourth end against resistance of the water, a flexible line having a third length, a fifth end and a sixth end, the fifth end of said flexible line attached to the second end of said first buoyant bar, the sixth end of said flexible line attached to the third end of said second buoyant bar, and a third buoyant tubular bar mounted on said flexible line, spaced from said first buoyant bar and said second buoyant bar, said first buoyant bar being longer than said flexible line taken from the second end of said first buoyant bar to the third end of said second buoyant bar.

7. The apparatus of claim 6 wherein said first buoyant bar is a tube.

* * * * *